United States Patent [19]

Jungreis et al.

[11] Patent Number: 4,894,587

[45] Date of Patent: Jan. 16, 1990

[54] HIGH FREQUENCY GAS DISCHARGE LAMP DIMMING BALLAST

[75] Inventors: Aaron Jungreis, Allentown; Dennis Capewell, Penllyn; David G. Luchaco, Macungie, all of Pa.

[73] Assignee: Lutron Electronics Co., Inc., Coopersburg, Pa.

[21] Appl. No.: 45,898

[22] Filed: May 4, 1987

Related U.S. Application Data

[63] Continuation-in-part of Ser. No. 642,072, Aug. 17, 1984, Pat. No. 4,663,570.

[51] Int. Cl.[4] ..... H05B 37/02

[52] U.S. Cl. ..... 315/200 R; 315/DIG. 4; 315/DIG. 5; 315/219; 315/224

[58] Field of Search ..... 315/DIG. 4, DIG. 5, 315/219, 221, 224, 244, 307, 308, 310, 279, 200 R

[56] References Cited

U.S. PATENT DOCUMENTS

| | | | |
|---|---|---|---|
| 3,265,930 | 8/1966 | Powell, Jr. | 315/310 X |
| 3,906,302 | 9/1975 | Wijsboom | 315/209 R |
| 4,129,805 | 12/1978 | Sherman | 315/219 |
| 4,253,046 | 2/1981 | Gerhard et al. | 315/307 |
| 4,348,615 | 9/1982 | Garrison et al. | 315/219 |
| 4,385,262 | 5/1983 | Cambier et al. | 315/DIG. 4 |
| 4,559,478 | 12/1985 | Fuller et al. | 315/224 |
| 4,663,570 | 5/1987 | Luchaco et al. | 315/DIG. 4 |
| 4,695,770 | 9/1987 | Raets | 315/219 |

*Primary Examiner*—Leo H. Boudreau
*Assistant Examiner*—Michael Razavi
*Attorney, Agent, or Firm*—Ostrolenk, Faber, Gerb & Soffen

[57] ABSTRACT

A high frequency dimming ballast dims to about 1 percent of rated output in a repeatable way so that parallel connected dimming ballasts will all produce the same light illumination when dimmed to a very low percentage of their rated light output. A first current sensor is connected in series with a semiconductor power switching device which is coupled to and controls power to the ballast. A second current sensor is connected directly to the lamp circuit to detect actual lamp current, particularly at low illumination conditions, for example at less than 10 percent of the rated light output. Lamp control under low illumination conditions is derived from the lamp current sensor and overrides control by the sensor in series with the transistor switch means.

25 Claims, 3 Drawing Sheets

FIG. 1 (PRIOR ART)
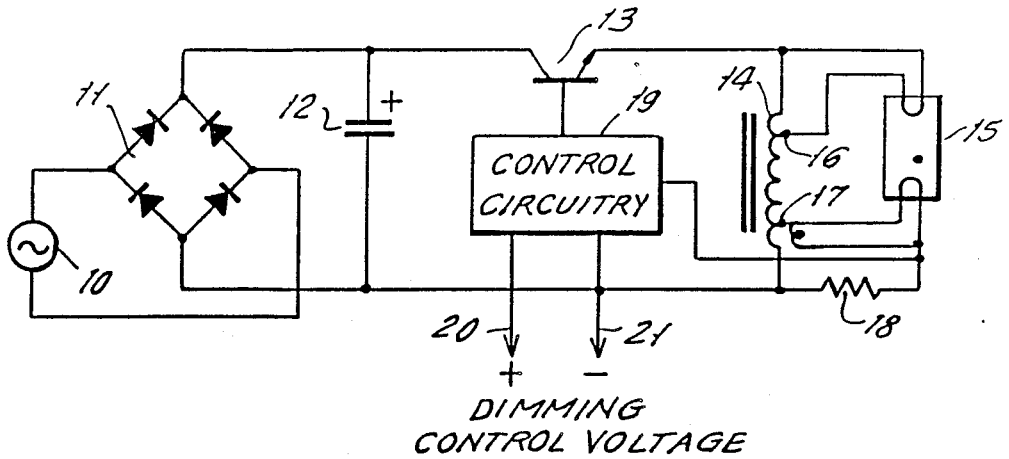
FIG. 2
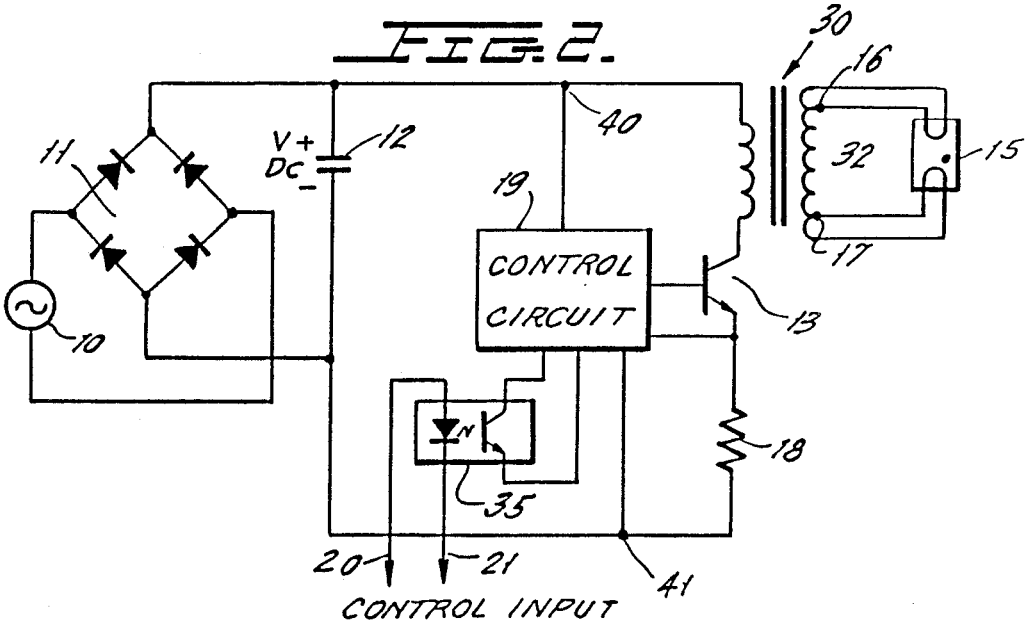
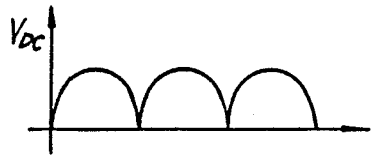
FIG. 3
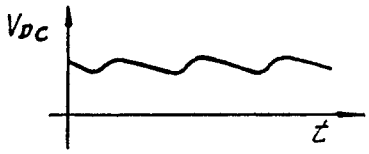
FIG. 4

HIGH FREQUENCY GAS DISCHARGE LAMP DIMMING BALLAST

RELATED APPLICATIONS

This application is a continuation-in-part of copending application Ser. No. 642,072 filed Aug. 17, 1984 entitled "High Frequency Gas Discharge Lamp Dimming Ballast", now U.S. Pat. No. 4,663,570.

BACKGROUND OF THE INVENTION

This invention relates to high frequency gas discharge lamp dimming ballasts, and more particularly relates to a novel control circuit for such devices which enables accurate dimming control at low light output levels. This application is a continuation-in-part of copending application Serial No. 642,072 filed Aug. 17, 1984 entitled "High Frequency Gas Discharge Lamp Dimming Ballast" in the names of David Luchaco and Dennis Capewell, now U.S. Pat. No. 4,663,570.

In the circuits disclosed in the above-noted parent application, gas discharge lamp current is indirectly monitored by monitoring the current through a power transistor switch which applies power in a controlled manner to the lamp ballast, rather than by directly monitoring the lamp current. This has the advantage of isolating the current sensing circuitry from the lamp lead wiring so that miswires at the lamp will not defeat the current measuring loop operation which would lead to the destruction of the power transistor.

A disadvantage of this arrangement occurs when the lamp is operated at very low light output, for example at one percent of the full light output of the lamp. Under this condition, the lamp filament current becomes a significant portion of the total current to the lamp load. Therefore, the current through the transistor switch is no longer an accurate measure of the actual arc power in the lamp. By way of example, in a 40 watt lamp the actual lamp arc power when dimmed to one percent of full light will be less than about one-half watt. The lamp filaments, however, require a relatively constant power which is independent of light output and may consume about one watt each. Thus, the total power to the lamp when dimmed to one percent of full light output is about 2½ watts but only about 20 percent of this contributes to actual light output. If one were to change the power delivered to the lamp from 2½ watts to 2¼ watts, the actual lamp arc power will be reduced by 50 percent (from ½ watt to ¼ watt). Thus the light output will change by 50 percent due to a change in the transistor switch current of less than 15 percent.

At higher light levels where the arc power is greater than about four watts (10 percent of the total light output of the 40 watt lamp), the distinction between the current measured in the power transistor as compared to the total power to the lamp is relatively unimportant.

This sensitivity to very small variations in the switch current at low dim levels makes it difficult to maintain accurate dimming control at relatively low dim values, for example less than about 10 percent of the full light output. Accurate low end control, however, is necessary, particularly when several lamps near one another are operated from separate dimmers since their visual appearance at low dim may be very different. Moreover, it is desirable to have accurate low dim control to prevent dimming below safe levels.

SUMMARY OF THE INVENTION

In accordance with the present invention, a sensor is added to the circuit to sense actual lamp arc current and to apply this information to the transistor control circuit, particularly when the lamp is dimmed to a low level, for example less than 10 percent. This lamp arc current control mode is used at low dim levels and the transistor switch current control mode is used at higher dim values.

The control of the transistor switch in response to the measured lamp current alone was previously known. Thus, control from a lamp current sensor alone is employed in commercial products of Lutron Electronics Co., Inc., the assignee of the present application, namely products which are manufactured and sold under the trademarks "Hi-Lume" and "Hyperion". Such an arrangement is also shown in U.S. Pat. No. 3,265,930 to Powell.

In these prior art arrangements there is always a direct connection between the lamp leads and the current sensing loop. Consequently, miswires or inadvertent grounding of lamp leads, can lead to destruction of the power semiconductor devices. The use of a current transformer to isolate the current sensing circuitry from the a-c current in the lamp leads of arrangements such as that of the patent to Powell do not solve the danger of a miswire since miswiring at the lamp leads can cause the loss of the current feedback signal which, in turn, would cause the power device to drive excessive output current to the negative resistance lamp load until it is destroyed.

Further, if a current transformer were used in the prior art arrangement, it would have to be designed to operate properly over the full range of current at which the lamps operate. If this is a large range, such as 100:1 or more, the transformer must provide good accuracy at low currents and must not saturate at high currents. These conflicting requirements can be met only by a large and expensive current transformer design.

These disadvantages of the prior art come about because the same feedback signal is used to both ballast the lamp (control the tendency of its negative resistance to draw excessive current) and to accurately control low end arc current This requires that the range of authority of the control loop be very large with no fallback or safety circuitry to prevent circuit destruction if the single feedback loop is disabled In accordance with the present invention, there are two feedback loops which produce a combined output to the control circuit. The first is that employing the current sensor directly in series with power transistor or main switch and the second is that measuring the actual lamp current, which is implemented as a trimming loop with a limited range of authority. That is, the range of authority of the lamp current measuring loop is only about 10 percent of the total lamp current. Therefore, even if a miswire occurs in wiring the current transformer and lamp leads to result in a total loss of the current feedback loop from the lamp current measuring equipment, the circuit will still operate safely due to the unhampered feedback loop of the switch current sensor which is still present.

Moreover, the current transformer will be relatively small since it must provide accurate feedback only in the low end of the light control range and can be allowed to saturate at higher currents.

BRIEF DESCRIPTION OF THE DRAWINGS

FIG. 1 is a circuit diagram of a prior art Hi-Lume dimming device.

FIG. 2 is a circuit diagram of a control circuit employing transistor switch current sensing.

FIG. 3 shows the output voltage on the filter capacitor of FIG. 2 when the inverter is delivering full lamp output.

FIG. 4 shows the voltage on the filter capacitor of FIG. 2 at reduced lamp power condition.

DESCRIPTION OF THE PREFERRED EMBODIMENTS

Figure 5:
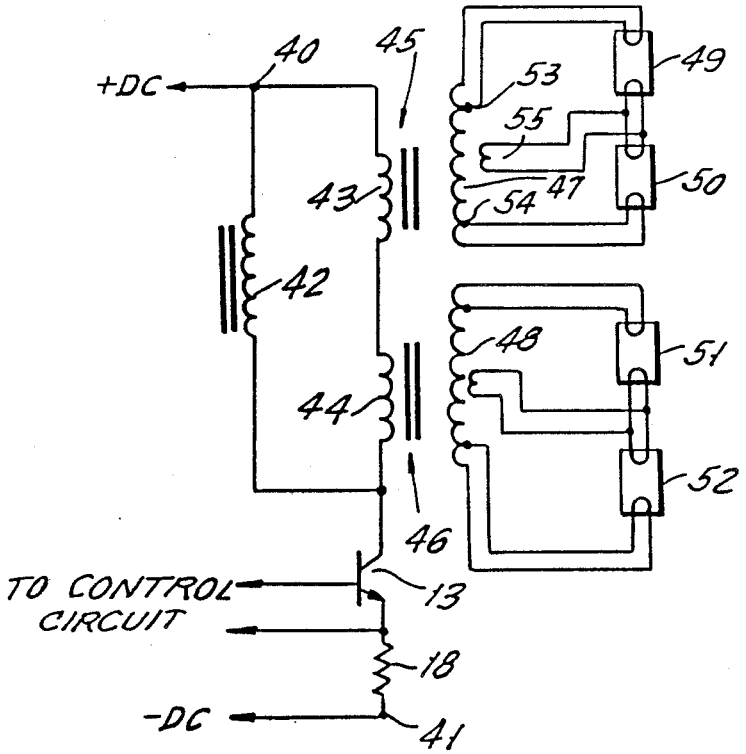
FIG. 5 is a circuit diagram of an isolated output transformer arrangement employing plural lamps which are forced to share current equally.

Referring first to the circuit of FIG. 1, there is shown therein a prior art Hi-Lume electronic ballast which is capable of a wide degree of regulation and which has been manufactured and sold by the assignee of the present invention for many years. The circuit is operated from an a-c source 10, which can be a conventional, commercially available source of voltage, e.g. 110, 220 or 277 volts at 50 or 60 Hz. The output of the source 10 is applied to the conventional single phase full wave bridge connected rectifier 11, which delivers a rectified output across a relatively large filter capacitor 12, which is an electrolytic capacitor. The positive terminal of bridge 11 is also connected to the collector of the schematically illustrated bipolar switching transistor 13, which in turn is connected to the output inductor 14 and gas discharge lamp 15, which can be any desired gas discharge lamp, e.g. a fluorescent lamp. Taps 16 and 17 on the output inductor 14 provide a source of filament voltage for the filaments of the gas discharge lamp 15.

A current sensing resistor 18 is connected in series with the lamp 15 and produces an output voltage which is applied to control circuitry 19. Control circuitry 19 can be of any desired type and receives an input dimming control voltage on leads 20 and 21 which control, in combination with the current sensing resistor 18, the control signal applied to the base of transistor 13 and tends to regulate the output to keep the current through current sensing resistor 18 to a value set by the dimming voltage control signal at lines 20 and 21.

The circuit of FIG. 1 is a relatively simple structure having excellent dimming performance. The circuit uses the simple output inductor 14 as a pulse forming network and the current sensing resistor 18 is in series with the lamp arc current. The control circuitry 19 is arranged to rectify and filter the voltage across resistor 18, which is proportional to lamp arc current. This monitored voltage value is then compared to the dimming control voltage input and the duty cycle of the switching transistor 13 is then adjusted until the lamp arc current is stable at the level commanded by the magnitude of the dimming voltage control applied to leads 20 and 21. The large filter capacitor 12 simply supplies smooth d-c voltage to the inverter portion of the circuit.

The circuit of FIG. 1 employs an accurate servo feedback loop, which results in very stable dimming capability. This, however, is at the expense of a large filter capacitor which reduces the power factor of the circuit. Moreover, the control circuitry 19 is relatively complex in order to provide a stabilized internal servo loop and is relatively expensive. Thus, the entire circuit is relatively expensive, even though only a single power switching device and a relatively simple magnetic structure is used. Miswiring of the lamp leads for the lamp 15 can also result in failures since the leads are directly connected to the power switch 13 and control circuitry 19. Also, the dimming control leads are necessarily referenced directly to the a-c line through the bridge connected rectifier 11. Therefore, there are increased costs since isolation amplifier circuitry and current surge reduction circuitry must be used in conjunction with any significant numbers of the circuits of FIG. 1.

FIG. 2 is a circuit diagram of a circuit which retains the simple basic structure and excellent dimming performance of the prior art circuit of FIG. 1. However, in FIG. 1 capacitor 12 is about 300 microfarads, whereas in the circuit of FIG. 2 it is about 3 microfarads. Depending on the size of the lamp load, prior art circuits have used capacitances of as low as 35 microfarads, for low lamp loads. However, the invention contemplates the use of capacitance values less than about 30 microfarads, even for high lamp loads.

As further shown in FIG. 2, the output inductor has been replaced by the two winding transformer 30 having a primary winding 31 which is dielectrically isolated from and magnetically coupled to the secondary winding 32. The secondary winding 32 contains the taps 16 and 17 for operating the filament of the gas discharge lamp 15.

The switching transistor 13 in FIG. 2 is then connected in series with winding 31 and in series with the current sensing resistor 18. Significantly, the current sensing resistor 18 of FIG. 2 is connected in series with the transistor 13, rather than in series with the actual lamp current of lamp 15 as in FIG. 1.

A further significant change from the circuit of FIG. 1 is the employment of a standard optoisolator 35 for coupling the input signal at the control input lines 20 and 21 to the control circuitry 19. The optoisolator 35 consists of any conventional internal arrangement, such as a light emitting diode which is optically coupled to, but dielectrically insulated from, a light sensitive transistor, which are the schematically illustrated components in FIG. 2.

The arrangement shown for the lamp 15, which is operated from an isolating transformer 30, permits galvanic isolation of the lamp from the switching circuitry. This precaution practically eliminates the possibility of circuit failure due to miswiring of the lamp leads since such errors can no longer disable the current sensing circuitry, or cause direct shorts to ground from the a-c line.

The filter capacitor 12 is made much smaller in the circuit of FIG. 2 and acts as a high frequency short at the power supply terminals of the a-c line 10. However, the capacitor does not significantly affect the line power factor at full lamp output. Thus, when the inverter is delivering full lamp power, the current drain serves to discharge the capacitor 12 rapidly so that the d-c bus voltage has the typical unfiltered full wave rectified voltage waveform shown in FIG. 3. Thus, there is an excellent line power factor at full lamp output. When, however, the lamp output current is relatively low, the capacitor voltage across capacitor 12 does not follow the line voltage waveform but appears, for example, as shown in FIG. 4. Therefore, at low output levels, power factor is reduced. This, however, has no significant disadvantage at the low current level, and the smoother d-c waveform improves lamp stability and dimming performance at the low end of the dimming range.

As pointed out above, it is also significant in the circuit of FIG. 2 that lamp arc current is not measured by the current sensing resistor 18, as in the case of FIG. 1, but instead the power switch current is measured. This connection removes the current sensing resistor 18 from the lamp terminals and thus helps avoid miswire problems. Moreover, in the circuit of FIG. 2, the power switching device 13 remains on until an upper current limit is exceeded and then turns off and remains off until an internal oscillator (not shown) within the control circuitry 19 turns it back on to start a new cycle.

The circuit of FIG. 2 also provides a control current loop which is inherently stable, provides rapid response and greatly reduces the complexity of the control circuitry. Such rapid response prevents the power switching transistor 13 from exposure to current surges which are above its normal design levels, even under unusual operating conditions such as those caused by miswiring.

The use of the optoisolator 35 permits a more direct connection from the dimming contol leads to the control circuitry 19. Thus, in the past a variable d-c voltage input has been used. The optoisolator 35 permits the use of a variable duty cycle square wave input to the control leads 20 and 21 for more direct control of the system. This, again, allows easier wiring, since multiple ballasts with paralleled control leads no longer need be fed from the same a-c phase line. The optocoupler also provides improved noise immunity for the system.

Multiple lamps can be operated from a single ballast circuit by forcing the multiple lamps to equally share the arc current provided by the ballast. Such a current dividing circuit is shown in FIG. 5, wherein components similar to those of FIG. 2 have been given similar identifying numerals. Thus, in FIG. 5 the nodes 40 and 41 correspond to the nodes 40 and 41 in FIG. 2. A single ballast inductor 42 is connected in parallel with primary windings 43 and 44 of transformers 45 and 46, which have respective secondary windings 47 and 48. The turns ratio of windings 43 and 44 to secondary windings 47 and 48 may be 1:2. Each of windings 47 and 48 is connected to drive two series connected lamps 49–50 and 51–52, respectively. Winding taps 53 and 54 are connected to one filament of each of lamps 49 and 50, and a central winding tap 55 is connected to the other filaments of each of lamps 49 and 50 as shown in FIG. 5. A similar arrangement is provided for transformer 46 and lamps 51 and 52.

It will be observed that any desired number of transformers 45 and 46 could have been used to produce any desired number of lamps in the particular bank described in FIG. 5. Each set of lamps consists of only two lamps in series, thus limiting the maximum voltage necessary in the ballast This method of balancing the current between a plurality of lamps is made possible through the use of the isolated output transformer, and with the remote disposition of the current sensing resistor. Inductor 42 of FIG. 5 acts as a separate energy storage inductor, while the output transformers 45 and 46 carry the same primary current, thus insuring equal division of current between the lamps 49 through 52.

The scheme shown in FIG. 5 requires three separate magnetic elements Thus, the ballast becomes relatively complex, but the ability to force sharing of current between four lamps, instead of two, is very cost effective for the overall unit.

Figure 6:
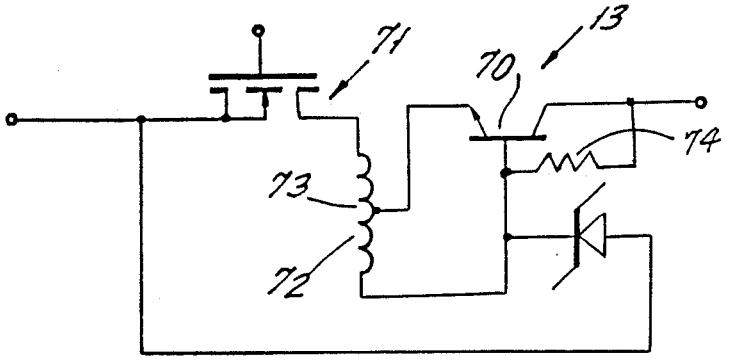
FIG. 6 is a circuit diagram of a single power switch and electrical drive circuitry therefor.

As disclosed in FIG. 6, the single, high voltage switching device 18 can be formed of a high voltage NPN transistor 70, which is connected in series with a low voltage power MOSFET 7. These components are connected in the well-known cascode circuit arrangement. The NPN transistor 70 may be a type MJE 13007A (Motorola) device and the MOSFET 71 may be a BUZ 71 (Siemens) device. The bipolar transistor 70 produces the necessary high voltage withstandability required for the switch 13, while the MOSFET 71 provides the desirable high speed operation for the device.

A control circuit is also employed in FIG. 6, which insures cooperation in the operation of transistors 70 and 71, while avoiding second breakdown of the bipolar transistor 70. Thus, a current transformer 72 is provided, which has 24 turns on a ferrite core. A four turn tap section 73 is connected in series between the emitter of transistor 70 and the drain of transistor 71 as shown. The remainder of the winding is then connected to the base of transistor 70. A Zener diode is then connected between the base of transistor 70 and the source of transistor 71 as shown. The control circuit 19 of FIG. 2, for example, is then connected to the gate of MOSFET 71 in order to switch on and off the switching structure 13. Resistor 74 is connected between the base and collector terminals of bipolar transistor 70.

In operation, assuming that the switch 13 is in conduction and a signal is produced to turn off the switch 13, the MOSFET 71 shuts off extremely rapidly, thereby causing a sharp drop in the emitter current of the bipolar transistor 70. The bipolar collector current which still flows during turn off will pass through the Zener diode and to the source lead of the MOSFET to fully turn off bipolar transistor 70. Thus, high speed turn off can be obtained while the MOSFET is still well protected.

Note that during conduction of the switch 13, emitter current passes through the four turn section 73 of transformer 72. Consequently, transformer 72 acts as a current transformer and forces one-fifth of the full emitter current into the base thereby generating the base drive for transistor 70. The ferrite core will be designed so that it will not saturate during this operation.

As a result, the above described circuit of FIG. 6 acts to provide high speed turn off and is very easy to drive. Moreover, second breakdown of the bipolar transistor 70 is prevented to make the bipolar transistor more rugged.

If the switch 13 is not conducting and a signal is applied to the gate of MOSFET 71 to initiate conduction, resistor 74 supplies a small amount of base current to cause bipolar transistor 70 to begin to conduct. The emitter current of transistor 70 then flows through section 73 of transformer 72, forcing the bipolar transistor 70 into full conduction as described previously.

Figure 7:
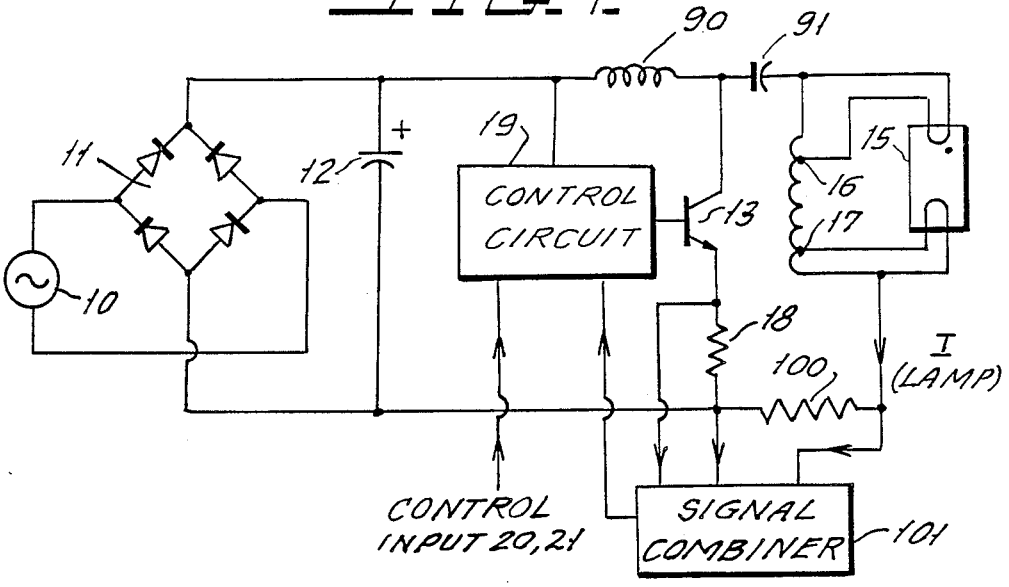
FIG. 7 is a circuit diagram of one novel control circuit of the invention in which inductive isolation is not employed between the switch current sensor and the lamp and in which a low lamp current control signal is added to the control system.

FIG. 7 shows one circuit of the invention which is similar to that of FIG. 2 and similar components have been given the same identifying numeral. In FIG. 7, however, the two winding transformer 30 of FIG. 2 has been removed and the lamp 15 is coupled to the output d-c voltage of the bridge 11 through energy storage inductor 90 and d-c isolation capacitor 91. Another transformer 14, similar to that of prior art FIG. 1, is added to provide taps 16 and 17 which heat the filaments of the tube 15. The novel circuit of FIG. 7 employs the current sensor 18 directly in series with transistor 13, except there is no inductive isolation of the current sensor 18 from the lamp leads. With this exception, the novel circuit may drive control circuit 19 in exactly the same manner as was described in connection with the circuit of FIG. 2.

Also shown in FIG. 7 is a low resistance shunt 100 directly in series with and monitoring the current $I_{lamp}$ which is the actual arc current of lamp 15. The output of low resistance shunt 100 and the output of current sensor 18 are combined in signal combiner 101. Signal combiner 101 may be a simple summing circuit with appropriate weighting functions for the signals from low resistance shunt 100 and current sensor 18, respectively. Therefore, when lamp current is low, the shunt 100 provides a predominating signal to the control circuit 19 to control the dimming of lamp 15 predominantly in response to the actual measured lamp current rather than only the current through the transistor 13 which is measured by the resistor 18.

By controlling the system at low light levels predominantly from the actual lamp current, the control is relatively unaffected by the difference between the transistor current and the lamp current due to the heater currents which are drawn by heater winding taps 16 and 17.

Figure 8:
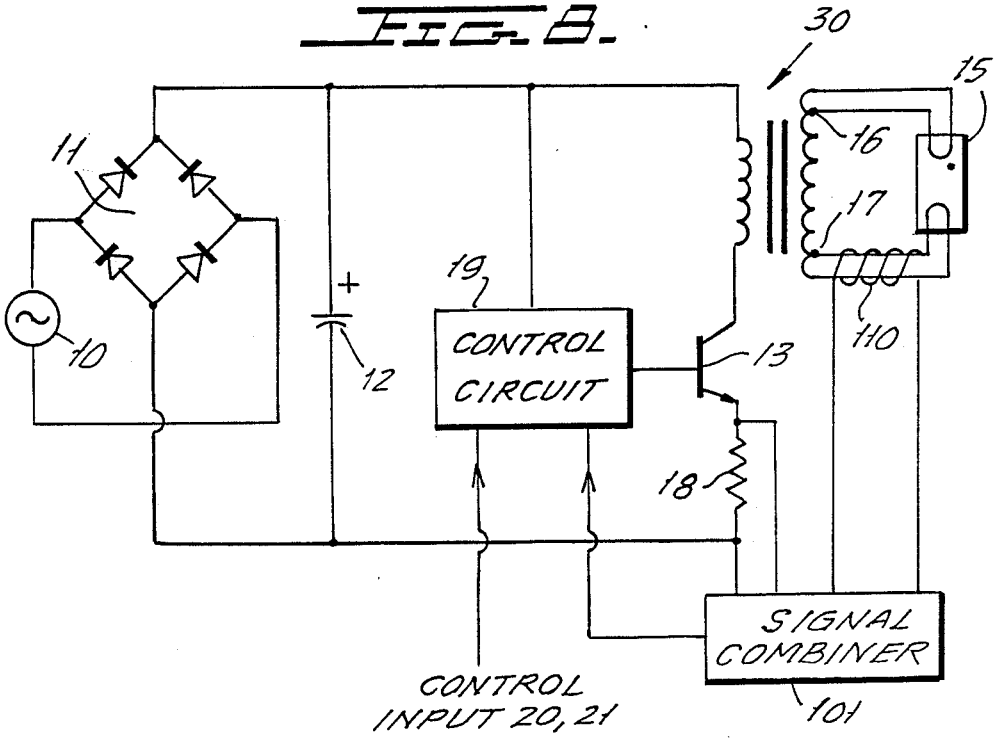
FIG. 8 is a circuit diagram similar to that of FIG. 2 where the novel low current feedback loop is derived from the lamp arc current and is employed to take predominant control of lamp dimming at dimming levels less than about 10 percent.

FIG. 8 shows an embodiment of the present invention in which a novel current transformer 110 is added to the circuit of FIG. 2 in order to measure accurately the exact lamp current which flows at low light output of the lamp 15. Current transformer 110 employs, as its primary winding, the leads extending from tap 17 to the lower filament. Its secondary winding can have as many turns as is desired.

The output of current transformer 110 is applied to the signal combiner circuit 101 which operates as described above so that when the lamp current is at a value less than about 10 percent of its value at full light output the output of shunt 110 plays the predominant role in controlling control circuit 19. Note that a miswire in the low current monitoring circuits 110 and 101 will not destroy lamp 15 or transistor 13 since as the current through the negative resistance load 15 increases, the current sensor feedback loop employing resistor 18 will take control and prevent destruction of the switch 13. Moreover, the current transformer 110 is a relatively small current transformer designed for high accuracy at low current and can be permitted to saturate at higher current values.

Although the present invention has been described in connection with preferred embodiments thereof, many variations and modifications will now become apparent to those skilled in the art. It is preferred therefore, that the present invention be limited not by the specific disclosure herein, but only by the appended claims.

What is claimed is:

1. An electronic ballast for a gas discharge lamp; said electronic ballast being dimmable over a large range; said ballast comprising: an a-c input circuit; a rectifier having a-c terminals connected to said a-c input circuit and having d-c output terminals; a filter capacitor connected across said d-c output terminals; a gas discharge lamp connected in circuit relation with said d-c output terminals and deriving its total energy therefrom; a single semiconductor switching means having a control electrode and first and second power terminals; a current sensing means; a control circuit connected to said control electrode and operable to turn said switching means on and off at a controlled duty cycle rate; a dimming level set circuit connected to said control circuit to set said duty cycle to a value related to a given degree of dimming of said lamp; said current sensing means being connected to said control circuit and operable to adjust said duty cycle to a value which maintains the current through said current sensing means at a value related to that called for by said dimming level set circuit; an energy storage inductor and a coupling capacitor; said d-c output terminals, said energy storage inductor, said single semiconductor switch means and said current sensing means being connected in closed series relation, said coupling capacitor coupling said ballast to said single semiconductor switch means.

2. The electronic ballast of claim 1, said gas discharge lamp having filaments and heaters in the filaments and further including transformer means coupled to said d-c output terminals and connected to the heaters of the filaments of said gas discharge lamp.

3. The electronic ballast of claim 1 wherein at least two series connected gas discharge lamps are connected across the terminals of each of said secondary windings.

4. The electronic ballast of claim 1 wherein said single semiconductor switching means comprises a bipolar transistor.

5. The electronic ballast of claim 1 which further includes a dielectrically isolated coupling device for coupling said dimming level set circuit to said control circuit.

6. An electronic ballast for a gas discharge lamp; said electronic ballast being dimmable over a large range; said ballast comprising: an a-c input circuit; a bridge connected rectifier having a-c terminals connected to said a-c input circuit and having d-c output terminals; a filter capacitor connected in parallel across said d-c output terminals; an energy storage element having first and second terminals; a coupling capacitor; a gas discharge lamp connected in circuit relation to said energy storage element and receiving its energy therefrom; a single semiconductor switching means which comprises a high voltage bipolar transistor and a low voltage power FET connected in cascode relation; and having a control electrode and first and second power terminals; a current sensing means; a control circuit connected to said control electrode and operable to turn said switching means on and off at a controlled duty cycle rate; a dimming level set circuit connected to said control circuit to set said duty cycle to a value related to a given degree of dimming of said lamp; said current sensing means being connected to said control circuit and operable to adjust said duty cycle to a value which maintains the current through said current sensing means at a value related to that called for by said dimming level set circuit; said d-c output terminals, said first and second terminals of said energy storage element, said single semiconductor switch means and said current sensing means being connected in closed series relation, said coupling capacitor coupling said gas discharge lamp to said energy storage inductor.

7. An electronic ballast for a gas discharge lamp; said ballast comprising: an a-c input circuit; a full wave bridge connected rectifier having a-c terminals connected to said a-c input circuit and having d-c output terminals; a filter capacitor connected across said d-c output terminals; circuit means coupling said gas discharge lamp to said d-c output terminals; a single semiconductor switching means having a control electrode and first and second power terminals; a current sensing means; a control circuit connected to said control electrode and operable to turn said switching means on and off at a controlled duty cycle rate; a current level set circuit connected to said control circuit to set said duty cycle to a value related to a given value of current in said lamp; said current sensing means being connected to said control circuit and operable to adjust said duty cycle to a value which maintains the current through said current sensing means at a value related to that called for by said current level set circuit; said d-c output terminals, said energy storage inductor, said single semiconductor switch means and said current sensing means being connected in closed series relation, said couplinq capacitor coupling said ballast to said single semiconductor switch means.

8. The electronic ballast of claim 7 which further includes heater tap sections connected to the heaters of the filaments of said gas discharge lamp and energized from d-c output terminals.

9. The electronic ballast of claim 7 which further includes a dielectrically isolated coupling device for coupling said current level set circuit to said control circuit.

10. An electronic ballast for a gas discharge lamp; said ballast comprising: a bridge connected rectifier having a-c terminals connected to said a-c input circuit and having d-c output terminals; a filter capacitor connected in parallel across said d-c output terminals; an energy storage element having first and second terminals; a gas discharge lamp coupled to said energy storage element; across the terminals of said secondary winding; a single semiconductor switching means having a control electrode and first and second power terminals; a current sensing means; a control circuit connected to said control electrode and operable to turn said switching means on and off at a controlled duty cycle rate; a current level set circuit connected to said control circuit to set said duty cycle to a value related to a given value of current in said lamp; said current sensing means being connected to said control circuit and operable to adjust said duty cycle to a value which maintains the current through said current sensing means at a value related to that called for by said current level set circuit; an energy storage inductor and a coupling capacitor; said d-c output terminals, said energy storage inductor, said single semiconductor switch means and said current sensing means being connected in closed series relation, said coupling capacitor coupling said ballast to said single semiconductor switch means.

11. The electronic ballast of claim 10 which further includes a dielectrically isolated coupling device for coupling said current level set circuit to said control circuit.

12. The electronic ballast of claim 10 wherein said single semiconductor switching means comprises a transistor.

13. An electronic ballast for a gas discharge lamp; said electronic ballast being dimmable over a large range; said ballast comprising: an a-c input circuit; a rectifier having a-c terminals connected to said a-c input circuit and having d-c output terminals; a filter capacitor connected across said d-c output terminals; circuit means coupling said gas discharge lamp to said d-c output terminals; a single semiconductor switching means which comprises a high voltage bipolar transistor and a low voltage power MOSFET connected in cascode relation, said switching means having a control electrode and first and second power terminals; a current sensing means; a control circuit connected to said control electrode and operable to turn said switching means on and off at a controlled duty cycle rate; a dimming level set circuit connected to said control circuit to set said duty cycle to a value related to a given degree of dimming of said lamp; said current sensing means being connected to said control circuit and operable to adjust said duty cycle to a value which maintains the current through said current sensing means at a value related to that called for by said dimming level set circuit; an energy storage inductor and a coupling capacitor; said d-c output terminals, said energy storage inductor, said single semiconductor switch means and said current sensing means being connected in closed series relation, said coupling capacitor coupling said ballast to said single semiconductor switch means; said ballast further comprising transformer means having a tap terminal means and end terminals; said end terminals connected to the base of said bipolar transistor and the drain of said MOSFET, respectively; said tap terminal connected to one of the emitter and collector of said bipolar transistor; the source of said MOSFET and one of the emitter and collector of said bipolar transistor which is not connected to said tap terminal being connected in said series circuit; and a Zener diode connected between said base of said bipolar transistor and said source of said MOSFET.

14. An electronic ballast for a gas discharge lamp; said electronic ballast being dimmable over a large range; said ballast comprising: an a-c input circuit; a bridge connected rectifier having a-c terminals connected to said a-c input circuit and having d-c output terminals; a filter capacitor connected across said d-c output terminals; an energy storage element having first and second terminals; a gas discharge lamp coupled to said energy storage element; a single semiconductor switching means which comprises a high voltage bipolar transistor and a low voltage power MOSFET connected in cascode relation, said switching means having a control electrode and first and second power terminals; a current sensing means; a control circuit connected to said control electrode and operable to turn said switching means on and off at a controlled duty cycle rate; a dimming level set circuit connected to said control circuit to set said duty cycle to a value related to a given degree of dimming of said lamp; said current sensing means being connected to said control circuit and operable to adjust said duty cycle to a value which maintains the current through said current sensing means at a value related to that called for by said dimming level set circuit; an energy storage inductor and a coupling capacitor; said d-c output terminals, said energy storage inductor, said single semiconductor switch means and said current sensing means being connected in closed series relation, said coupling capacitor coupling said ballast to said single semiconductor switch means; said ballast further including transformer means having a tap terminal means and end terminals; said end terminals connected to the base of said bipolar transistor and the drain of said MOSFET, respectively; said tap terminal connected to the emitter of said bipolar transistor; the source of said MOSFET and the collector of said bipolar transistor connected to said series circuit; and a Zener diode connected between said base of said bipolar transistor and said source of said MOSFET.

15. An electronic ballast for a gas discharge lamp; said ballast comprising: a bridge connected rectifier having a-c terminals connected to said a-c input circuit and having d-c output terminals; a filter capacitor connected across said d-c output terminals; an energy storage element having first and second terminals; a gas discharge lamp coupled to said energy storage element; a single semiconductor switching means which comprises a high voltage bipolar transistor and a low voltage power MOSFET connected in cascode relation, said switching means having a control electrode and first and second power terminals; a current sensing means; a control circuit connected to said control electrode and operable to turn said switching means on and off at a controlled duty cycle rate; a current level set circuit connected to said control circuit to set said duty cycle to a value related to a given value of current in said lamp; said current sensing means being connected to said control circuit and operable to adjust said duty cycle to a value which maintains the current through said current sensing means at a value related to that called for by said current level set circuit; an energy storage inductor and a coupling capacitor; said d-c output terminals, said energy storage inductor, said single semiconductor switch means and said current sensing means being connected in closed series relation, said coupling capacitor coupling said ballast to said single semiconductor switch means; said ballast further comprising transformer means having a tap terminal means and end terminals; said end terminals connected to the base of said bipolar transistor and the drain of said MOSFET, respectively; said tap terminal connected to the emitter of said bipolar transistor; the source of said MOSFET and the collector of said bipolar transistor connected to said series circuit; and a Zener diode connected between said base of said bipolar transistor and said source of said MOSFET.

16. A dimmable gas discharge lamp ballast, comprising, in combination: a pair of leads connectable to a d-c power source; a high speed power switching device connected in series with said pair of leads; a switching device current sensor connected in circuit relation with said power switching device for measuring the current carried by said high speed switching device and producing an output related thereto; a pair of gas discharge lamp terminals for connection in series with a gas discharge lamp means; said pair of lamp terminals connected in series with said pair of leads; a lamp current sensor coupled to and producing an output related to the current flow through a lamp means connected to said pair of gas discharge lamp terminals; a control circuit for controlling the conduction of said high speed power switching device in response to input signals derived from said switching device current sensor and said lamp current sensor to controllably change the power applied to a gas discharge lamp means connected to said terminals and cause predetermined dimming thereof from a full output light condition; said output of said lamp current sensor significantly controlling dimming when lamp current is less than about 10% of its value of said full output light condition; said output of said switching device current sensor significantly controlling dimming when said lamp current is greater than about said 10% of its value at said full output light condition.

17. The ballast of claim 16, wherein said high speed power switching device is a power semiconductor device.

18. The ballast of claim 16, wherein said switching device current sensor is a resistor.

19. The ballast of claim 16, which further includes a two winding transformer coupled between and inductively coupling said power switching device and said lamp terminals.

20. The ballast of claim 19, wherein said switching device current sensor is a resistor.

21. The ballast of claim 16, wherein said lamp current sensor is a current transformer.

22. The ballast of claim 20, wherein said lamp current sensor is a current transformer.

23. The ballast of claim 2, which further includes a second circuit sensing means connected in circuit relation with said gas discharge lamp and producing an output related to the current through said lamp; and circuit means connecting said output means to said control circuit for controlling the dimming of said lamp when lamp current is less than about 10% of its value at full light output of said lamp.

24. The ballast of claim 23 wherein at least two series connected gas discharge lamps are connected across the terminals of each of said secondary windings.

25. The ballast of claim 23 wherein said single semiconductor switching means comprises a bipolar transistor.

* * * * *